US006802098B2

(12) United States Patent
Geyer et al.

(10) Patent No.: US 6,802,098 B2
(45) Date of Patent: Oct. 12, 2004

(54) CYLINDRICAL BRUSH IDLER-SIDE TAPER ADJUSTMENT ASSEMBLY

(75) Inventors: Robert A. Geyer, Minnetonka, MN (US); Anthony J. Hamline, Becker, MN (US)

(73) Assignee: Tennant Company, Minneapolis, MN (US)

( * ) Notice: Subject to any disclaimer, the term of this patent is extended or adjusted under 35 U.S.C. 154(b) by 253 days.

(21) Appl. No.: 09/852,196

(22) Filed: May 9, 2001

(65) Prior Publication Data

US 2001/0034916 A1 Nov. 1, 2001

Related U.S. Application Data

(60) Provisional application No. 60/202,599, filed on May 9, 2000.

(51) Int. Cl.[7] ..... A47L 11/19; A47L 11/40

(52) U.S. Cl. ..... 15/52.1; 15/82; 15/368

(58) Field of Search ..... 15/320, 340.1–340.4, 15/355, 368, 373, 50.3, 52.1, 82; 384/255; 474/133; 492/45, 47

(56) References Cited

U.S. PATENT DOCUMENTS

| | | | | |
|---|---|---|---|---|
| 1,507,417 A | * | 9/1924 | Orr | 15/354 |
| 1,531,701 A | | 3/1925 | Jossart | 15/50.3 |
| 2,115,265 A | | 4/1938 | Jennett | 30/276 |
| 2,529,797 A | | 11/1950 | Cauble | 56/295 |
| 2,529,870 A | | 11/1950 | Golasky | 56/25.4 |
| 2,697,323 A | | 12/1954 | Horn | 56/295 |
| 3,671,996 A | * | 6/1972 | Gaudry | 15/368 |
| 4,189,905 A | | 2/1980 | Frantello | 56/295 |
| 4,505,040 A | | 3/1985 | Everts | 30/296 |
| 4,715,173 A | | 12/1987 | Anderson | 56/295 |
| 4,860,525 A | | 8/1989 | Chee | 56/12.7 |
| 5,152,027 A | | 10/1992 | LaBoda | 15/83 |
| 5,244,333 A | | 9/1993 | Byrne | 414/501 |
| 5,404,697 A | | 4/1995 | Dewey | 56/12.7 |
| 5,414,934 A | | 5/1995 | Schlessmann | 30/275.4 |
| 5,599,233 A | | 2/1997 | Shaulis | 464/52 |
| 5,622,035 A | | 4/1997 | Kondo et al. | 56/12.7 |
| 5,802,824 A | | 9/1998 | Aldrich | 56/13.7 |
| 5,819,352 A | | 10/1998 | Bancroft et al. | 15/52.1 |
| 5,855,069 A | | 1/1999 | Matsubayashi et al. | 30/276 |
| 5,862,655 A | | 1/1999 | Altamirano et al. | 56/12.1 |
| 5,966,914 A | | 10/1999 | Reents | 56/16.7 |
| 6,055,798 A | | 5/2000 | Fulmer et al. | 56/12.7 |

* cited by examiner

*Primary Examiner*—Mark Spisich
(74) *Attorney, Agent, or Firm*—Fulbright & Jaworski L.L.P.

(57) ABSTRACT

The present invention provides an adjustment mechanism and methods for adjusting the alignment of a powered cylindrical brush mounted to a surface maintenance vehicle relative to a surface to be maintained or cleaned by the vehicle. The device is preferably disposed upon the idler-side of a powered rotating cylindrical brush assembly and the adjustment preferably occurs via use of an eccentric cam member providing a range or motion, or pivot location, through or about which the idler-side mounting location of the cylindrical brush may be adjusted to improve contact with the surface. The present invention enables such adjustment without decoupling the rotating brush from its couplings (both supportive and rotational coupling), and any coupling to a drive mechanism for driving the rotating brush into rotation. The rotating brush so adjusted will benefit from improved mechanical cooperation between the bristles of the brush and the surface to be cleaned. If at least two counter-rotating cylindrical brush assemblies are disposed on a single surface maintenance vehicle each may be adjusted with respect to the surface and to the other brush disposed therein. Another aspect of the present invention is to allow a single operator to perform brush taper adjustments without disassembly of any connecting components for operating the rotating cylindrical brush assembly during cleaning operations, including even the side covers or other brush mounting components and any drive gear associated thereto. The apparatus and methods of the present invention are intended to readily accommodate rapid adjustment in the course of surface cleaning operations by a single manual operator or technician preferably either by hand or via use of a single rudimentary adjustment instrument operating upon a single adjustable mounting location to change the state of the single adjustable mounting location from a partially-released state to a fully-coupled state.

22 Claims, 7 Drawing Sheets

CYLINDRICAL BRUSH IDLER-SIDE TAPER ADJUSTMENT ASSEMBLY

This application for utility patent coverage in the United States of America hereby incorporates by reference and, under 35 U.S.C. §119(e), claims the benefit of U.S. Provisional Patent Application No. 60/202,599 filed May 9, 2000, and entitled, "Cylindrical Brush Idler Side Taper Adjustment Assembly."

FIELD OF THE INVENTION

The present invention is directed to a cylindrical brush alignment device, particularly for use in association with a surface maintenance vehicle.

BACKGROUND OF THE INVENTION

Surface maintenance vehicles and cleaning devices have a long history subject to gradual innovation and improvement toward improved and oftentimes automated performance in removing debris and contamination from floors and other surfaces to be cleaned. These vehicles and devices may be self-powered, towed, or pushed, and/or manually powered and may carry a human operator during cleaning operations. Such vehicles and devices include scrubbers, extractors, sweepers and vacuums, as well as combinations thereof, intended for cleaning, scrubbing, wiping and/or drying a portion of a substantially flat surface both indoors and outdoors. Many such vehicles and devices employ one or more rotating brushes for sweeping debris from a floor and/or, in conjunction solution of water and a detergent, providing scrubbing action via one or more of the rotating brushes. The brush assembly of such prior art cleaning vehicles may mount to the vehicle at any convenient location. However, due consideration of potential cooperation and/or synergy with other cleaning apparatus used by the surface maintenance vehicle typically dictates that the brush assembly couples at or near the middle or front portion of the vehicle. Cleaning solution(s) may be pumped or sprayed via traditional means to the surface near the rotary scrub brushes operating from a lower portion of the vehicle. Some of the rotary scrub brushes may have a substantially vertical axis of rotation and others may have a substantially horizontal axis of rotation. The configuration between a pair or set of these rotary scrub brushes are generally spaced apart so as to cooperate toward the collection and removal of particles and debris from the surface using consistent contact with the surface to be cleaned and the bristle ends of each of said rotary brushes. The length of the cylindrical brushes are often sufficiently wide to at least cover the path width of the wheels of the cleaning vehicle.

Floor scrubbing vehicles are widely used to clean the floors of industrial and commercial buildings. They range in size from a small model which may clean a path ranging from perhaps 15 inches up to 36 inches wide controlled by an operator walking behind it, to a large model cleaning a path as wide as five feet controlled by an operator riding on the machine. In general, these machines have a wheeled chassis which contains, in addition to power and traction drive means, a tank to hold clean scrubbing solution and a vessel to hold debris recovered from the surface being scrubbed. A scrub head is attached to the chassis by an articulated linkage system, and may be located in front of, under or behind the chassis. The scrub head contains one or more rotating scrub brushes and means to power them. These brushes may be either flat disc brushes that rotate about vertical axes or they may be cylindrical brushes rotating about horizontal axes. Both systems have their advantages and disadvantages, and both are widely used. An early example of such a surface maintenance device includes U.S. Pat. No. 3,702,488, which is incorporated by reference herein.

In addition, rotating cylindrical brush assembly and related drive and support structures for cleaning vehicles have been known and used in the art, such as that disclosed in U.S. Pat. No. 5,515,568 assigned to Tennant Company of Golden Valley, Minn. U.S.A. which issued on May 14, 1996 to Larson et al. and the contents of which are incorporated by reference herein, and U.S. Pat. No. 6,035,479 also assigned to Tennant Company, which issued on Mar. 14, 2000 to Basham et al. the contents of which are incorporated by reference herein. In these prior art references, a brush assembly includes a mounting plate mechanically connected to the brush assembly via many individual traditional threaded shank members and corresponding washers and threaded nuts and the like to firmly couple a brush assembly to the cleaning vehicle. The resulting metal-on-metal contact between the bolts, slots, washers and nuts provides a compression force of sufficient magnitude to ensure that the rotating brush assembly attachment cannot separate from the vehicle, but mainly depends upon the degree of tightening of individual bolts between diverse subcomponents of the assembly. In the event a brush requires taper adjustment, presumably each nut and bolt pair and other connecting components must be loosened and/or completed removed (and accounted for) and/or complete removal of at least one end of the brush assembly from its respective rotational mounting location. In addition, associated drive motor and motor coupling members may require time consuming partial disassembly and/or removal with possible risk of lost of parts.

If the operator is unable to release any of the connecting components or is unable to adequately tighten same, the operator may have to temporarily depart the facility being cleaned unless and until same may be rectified. If in fact the connecting components are overly loose, the brush assembly may disengage from the surface maintenance vehicle during cleaning operations with dire results for the facility, the surface being cleaned, the vehicle and perhaps even the operator of the vehicle with additional downtime, repair efforts, and/or adjustment resulting as a direct consequence.

Accordingly, the recited prior art approach as well a many other known assemblies rely on manually developed force between several opposing surfaces at diverse locations using conventional hardware. Unfortunately, as in the reference immediately above, the compressive forces required to fully assemble such prior art rotary brush assemblies are typically not susceptible of manual tightening of a knob or wing nut. Instead, diverse tools, both manually operated and independently powered, must be applied to each connecting subcomponent first during partial (or complete) disassembly of the subcomponent, during adjustment of the brush taper by adjusting the entire brush assembly relative to the vehicle and/or the surface to be cleaned, and later during re-attachment of each connecting subcomponent. Finally, such prior art approaches must be field tested to confirm that the adjustment to the brush taper effectively improved the sweeping operation of the surface maintenance vehicle. If not, then the entire procedure (i.e., partial/complete disassembly of each subcomponent, adjustment of the brush assembly relative to the vehicle and/or surface to be cleaned, and during re-attachment of each connecting subcomponent) must be performed again, perhaps repeatedly, until such adjustment is deemed adequate following field testing.

SUMMARY OF THE PRESENT INVENTION

The invention herein is primarily concerned with scrubbers that use two counter-rotating cylindrical brushes. The brushes are preferably set parallel to each other and are closely spaced, with their axes of rotation being horizontal and generally transverse to a longitudinal axis relative to the intended direction of travel of the vehicle. A major advantage of this configuration is that the cylindrical brushes, while scrubbing the floor, act cooperatively to also sweep up small particles and debris that may be on the surface being scrubbed and deposit them in a debris tray or other receptacle or vessel. Cylindrical brush mounting assemblies used on such vehicles may include alignment devices for adjusting the relative orientation of the brushes. These brush alignment devices are necessary to adjust the brush into equal ground contact along its longitudinal length. Known brush alignment procedures have typically required at least partial disassembly of the brush assembly from the maintenance vehicle, an inefficient adjustment procedure briefly described above and requiring a vehicle operator to halt cleaning operations, apply diverse tools to uncouple connecting parts of the brush assembly from the vehicle and the like with resulting loss of cleaning effort during such service and the potential for parts to be lost, misplaced or re-connected improperly or without adequate force.

Thus, the present invention addresses a long felt need for a brush alignment assembly which permits rapid, efficient and accurate adjustment of the brush alignment without requiring disassembly of the working components of the brush assembly and without disturbing the brush or the rotational mounts therefore.

The present invention provides an adjustment mechanism and methods for adjusting the alignment of a powered cylindrical brush relative to a surface to be maintained or cleaned by the vehicle. The device is preferably disposed upon the idler-side of a powered rotating cylindrical brush assembly and the adjustment preferably occurs via use of an member analogous to an eccentric cam, and said cam member is designed to provide a range of motion, or pivot location, through or about which the idler-side mounting location of the cylindrical brush may be adjusted to improve contact with the surface and/or to improve the degree of mechanical cooperation between at least two counter-rotating cylindrical brush assemblies disposed on a single surface maintenance vehicle.

Another aspect of the present invention improves brush taper adjustments by not requiring disassembly of any connecting components for operating the rotating cylindrical brush assembly during cleaning operations, except for partial release of mounting force to a housing for said brush assembly. Such housing member often includes a side cover member for each brush which supports the brush relative to the housing, and said side cover typically promotes manual access to more readily service portions of the brush assembly such as other brush mounting components and any drive gear associated thereto. Such a side cover is not required in practicing the present invention (i.e., to adjust the spacing between an axis of rotation of a rotating cylindrical brush relative to a surface to be brushed). As a result, an efficient adjustment process is provided which permits the operator to quickly adjust the brush taper. As used in this disclosure the term "taper" has its usual and ordinary meaning, that is a gradual decrease in the thickness or width of an elongated object. Adjustment of the brush taper is required from time to time in the course of operating a surface maintenance vehicle.

The apparatus and methods of the present invention are intended to readily accommodate rapid brush taper adjustment in the course of surface cleaning operations by a single manual operator using no tools or using no more than a single rudimentary adjustment instrument, or tool, operating upon a single adjustable mounting location to change the state of the single adjustable mounting location from a partially-released state to a fully-coupled state. In an alternative embodiment, such tool may be integrally formed with said single adjustable mounting location and/or adjacent structure and thereby shall be readily available for immediate use, as desired. In this alternate embodiment, such integrally formed tool may comprise a large wing-type nut and lock washer in combination, or an elongate lever handle, or a modified lever handle that folds into a recess formed adjacent the single mounting location. Of course, such a lever handle may include spring biasing to ensure that said lever handle remains in a retracted position when not is use to reduce the risk of an inadvertent transition from the fully-coupled state to the partially-released state. The inventors hereof confirm that each such adjustment may be performed rapidly by said single operator expending not more than a few minutes effort.

Yet another aspect of the present invention is to provide indicia upon an idler-side brush assembly cover plate, or housing, and/or to the adjustable eccentric cam member to provide reference indicia to the operator or technician during the alignment or adjustment process of the brush taper as taught, enabled, disclosed and claimed herein.

The present invention thus teaches, enables and discloses an improved, readily adjustable mechanical coupling for a rotary brush assembly usable in a surface maintenance vehicle. Such a vehicle includes those self-powered and manually powered cleaning vehicles applied to the task of removing particles and debris from a cleaned surface and preferably include all such vehicles using a rotary brush assembly. Such a surface may comprise interior or exterior flooring having some limited porosity but preferably comprising finished concrete (whether painted or sealed), asphalt, ceramic tile, resin-based tile, and the like and including most types of flooring typical of commercial and industrial-grade facilities. However, the teaching hereof finds application in diverse handling of particles and debris. The present invention is useable in diverse locations such as gymnasium floors, indoor and outdoor tennis courts, poolside flooring and the like. In addition, the present invention may be used for debris removal following spectator events at diverse indoor facilities or outdoor facilities where practice of the present invention speeds elimination of undesirable particles and debris present on, in and around such facilities.

During cleaning operations, as the maintenance vehicle is propelled forward over a portion of a surface to be cleaned, when the bristles of a rotary brush contacts the surface to be cleaned typical degradation and wear occurs to the bristles that eventually may change the effective area of contact between the bristles and the surface. The improved, readily adjustable mechanical coupling for the rotary brush assemblies taught herein provides a rapid and reliable method of accurately adjusting the orientation of the rotary brush thereby promoting improved contact between the bristles and the surface and accordingly, more effective removal of debris from said surface. Due to the design of the improved, readily adjustable mechanical coupling of the present invention, the rotary brush assembly remains operable and intact and securely coupled to its mounting locations on the surface maintenance vehicle while the brush taper adjustment occurs.

With respect to the variety of cylindrical brush assemblies and brushes available for use in conjunction with the present invention, U.S. Pat. No. 6,125,495 issued Oct. 3, 2000 and U.S. Pat. No. 6,003,186 issued Dec. 21, 1999 each of which is incorporated herein by reference should provide adequate detail regarding specifics of the construction, operation and design considerations for rotary brush assemblies. Both of the cited patents are owned by Tennant Company, assignee of the present invention. Although the present invention may be practiced using any variety of rotary brush having a substantially horizontal axis of rotation and operating in a surface maintenance vehicle. As noted in the patent references noted immediately above, the size, shape, composition and pattern(s) of the bristles of a substantially cylindrical rotating brush and the speed of rotation of same, including different rates of rotation between adjacent brushes may be used to improve and control the debris removing performance of surface cleaning vehicles such as those using the teaching of the present invention. In addition, various debris-handling features may be added to and used in conjunction with the present invention such as baffles, deflector shields, resilient flanges or conduit and the like may be designed and/or implemented to direct, redirect or collect such particles and debris in a specified location.

Those of skill in the art will recognize that various other structure may serve in lieu of the functionality provided by a eccentric cam member and secondary cam member as taught and illustrated herein. For example, a single cam member effectively integrating the function of the dual cam structure taught herein may be used to practice the present invention. While the drive means for the rotary brushes is depicted as an electrical motor mechanically coupled to drive a single brush into rotation, a single motor could drive more than one rotary brush. Also, the motor could operate using electricity, combustible materials, or could be driven via the same power source which propels the maintenance vehicle forward and may be articulated so that the rotary brush assembly may be independently moved up, over or down or placed in a variety of useful configurations relative to the surface maintenance vehicle. One object of the invention is to provide such an articulated brush assembly for a surface maintenance vehicle which is tolerant of wear forces imparted to the brush assembly, including the typical degradation and wear to bristles comprising said rotary brush.

These and other objects, features and advantages will become apparent in light of the following detailed description of the preferred embodiments in connection with the drawings. Those skilled in the relevant art will readily appreciate that these drawings and embodiments are merely illustrative and not intended to limit the true spirit and scope of the invention disclosed, taught and enabled herein.

BRIEF DESCRIPTION OF THE DRAWINGS AND INVENTION

Preferred embodiments of the invention will be described in detail hereinafter with reference to the accompanying drawings, in which like reference numerals refer to like elements throughout.

DETAILED DESCRIPTION OF THE PREFERRED EMBODIMENTS

Figure 1:
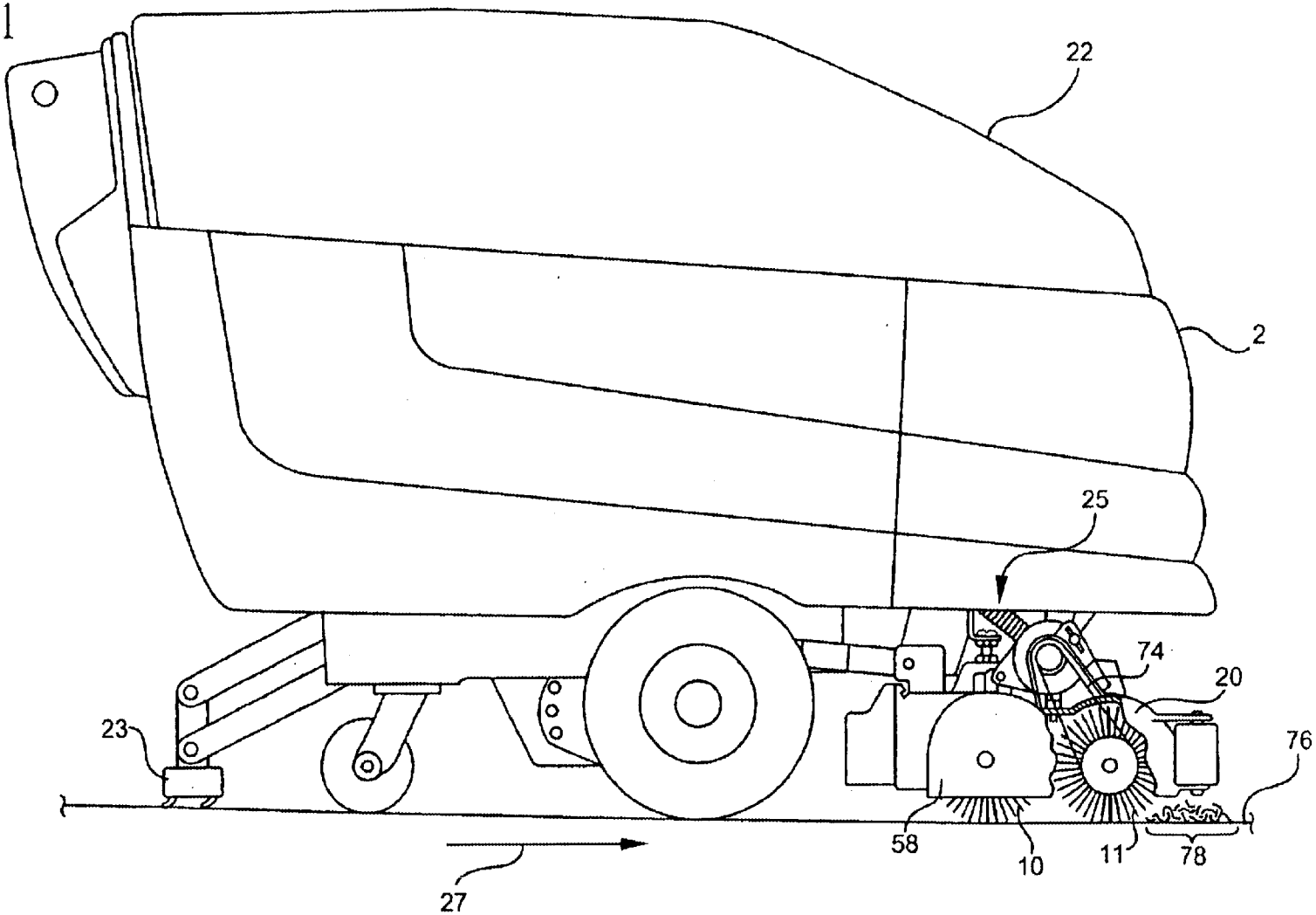
FIG. 1 is an elevational side view of a typical prior art walk-behind surface maintenance machine which may utilize the cylindrical brush alignment device of the present invention the idler side cover plate is indicated on the non-driven side of one of the rotary brushes of a counter-rotating brush assembly therein.
Figure 2:
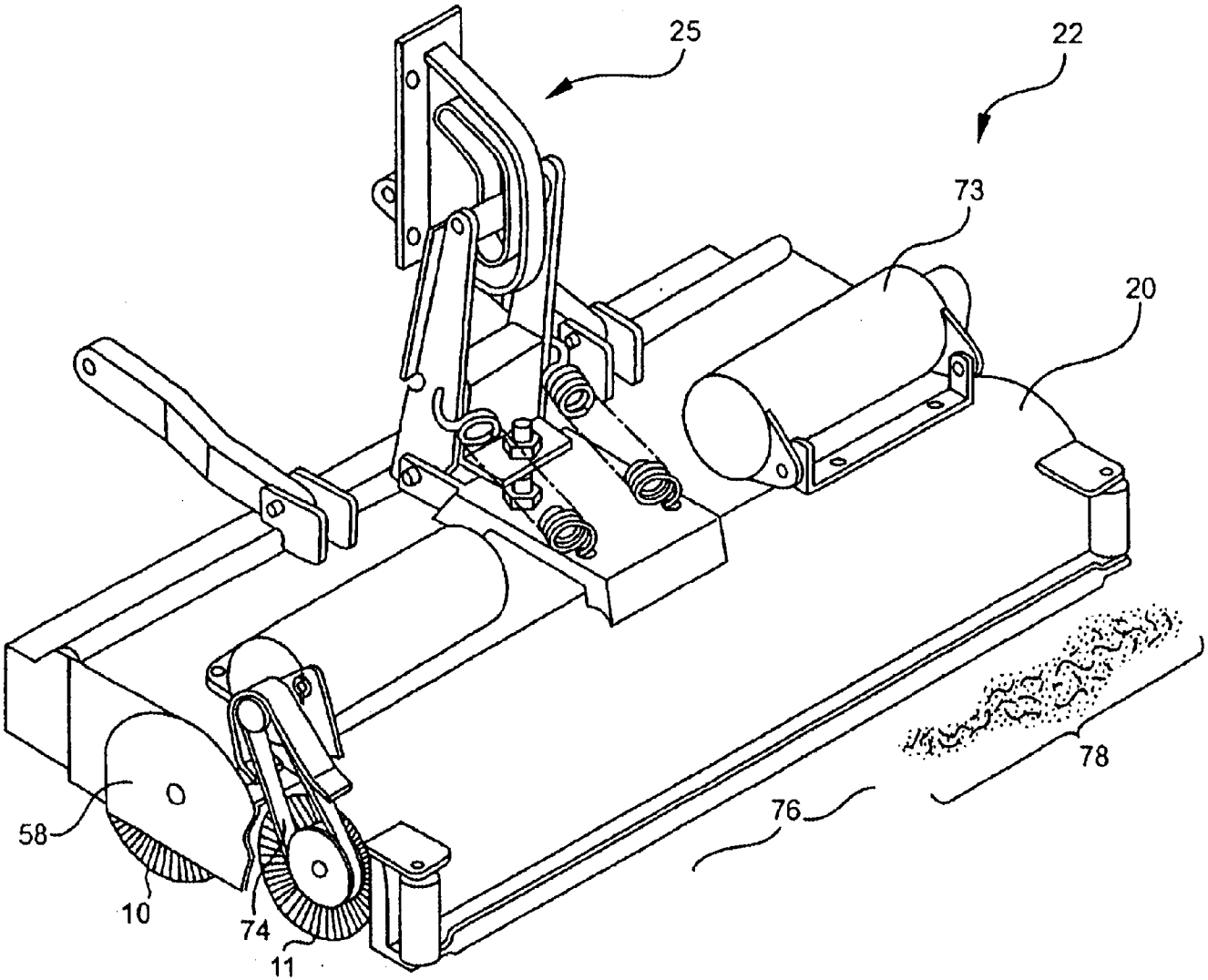
FIG. 2 is a perspective view of the brush assembly of the FIG. 1.

Representative industrial surface maintenance sweeper-scrubber machines which may benefit from use the present invention are shown in FIG. 1 and FIG. 2 which machines are offered simply to generally familiarize the uninitiated to this field of endeavor. Such surface maintenance machines, or generally, surface maintenance vehicles, may be used for sweeping and/or scrubbing substantially flat surfaces in schools, factories, warehouses, and other industrial or commercial establishments and the like. As shown in FIG. 1, a riding-type surface maintenance vehicle 22 has a frame 23, and is supported on a wheels and is propelled in a forward direction (indicated by arrow 27) during cleaning operations. Typically such a surface maintenance vehicle 22 includes a variety of implements such as brushes 10,11 and systems for dispensing cleaning solutions typically composed of detergent and water which suspend dirt. Such brushes 10,11 are often mechanically coupled near the front 2 of a surface maintenance vehicle 22. Such brushes 10,11 are typically operatively connected to a brush housing 20 and/or to a cover member 58 attached to the housing 20. The surface maintenance vehicle 22 is often also provided with a lifting mechanism 25 which is attached to the frame 23 of the surface maintenance vehicle 22. Individually powered by motors 72,73 typically drive the brushes 10,11 into rotation via suitable belts, gearing and the like (collectively 74). One example of such a surface maintenance vehicle is disclosed in U.S. Pat. No. 5,455,985, assigned to Tennant Company, assignee herein, and incorporated herein by reference in its entirety.

Alternatively, FIG. 2 illustrates a walk-behind surface maintenance vehicle, such a floor scrubbing vehicle disclosed in U.S. Pat. No. 5,483,718, assigned to Tennant Company, assignee herein, and incorporated herein by reference in its entirety. As with the above-mentioned riding-type surface maintenance vehicle, the walk behind surface maintenance vehicle 22 includes a variety of implements such as brushes 10,11 and a squeegee, or wiper assembly 23 (see FIG. 1) and the like and is capable of applying cleaning solutions to aid in the removal of contamination, particles and debris from a surface 76. The present invention, however, is concerned with releasably securing a portion of the rotary brush assembly to these types of vehicles, and the sweeping and other functional aspects of such brushes operating in a surface maintenance vehicle 22. The particular surface maintenance vehicles illustrated in FIG. 1 and FIG. 2 are thus relevant insofar as depicting a suitable environment with which the present invention is concerned.

Figure 3:
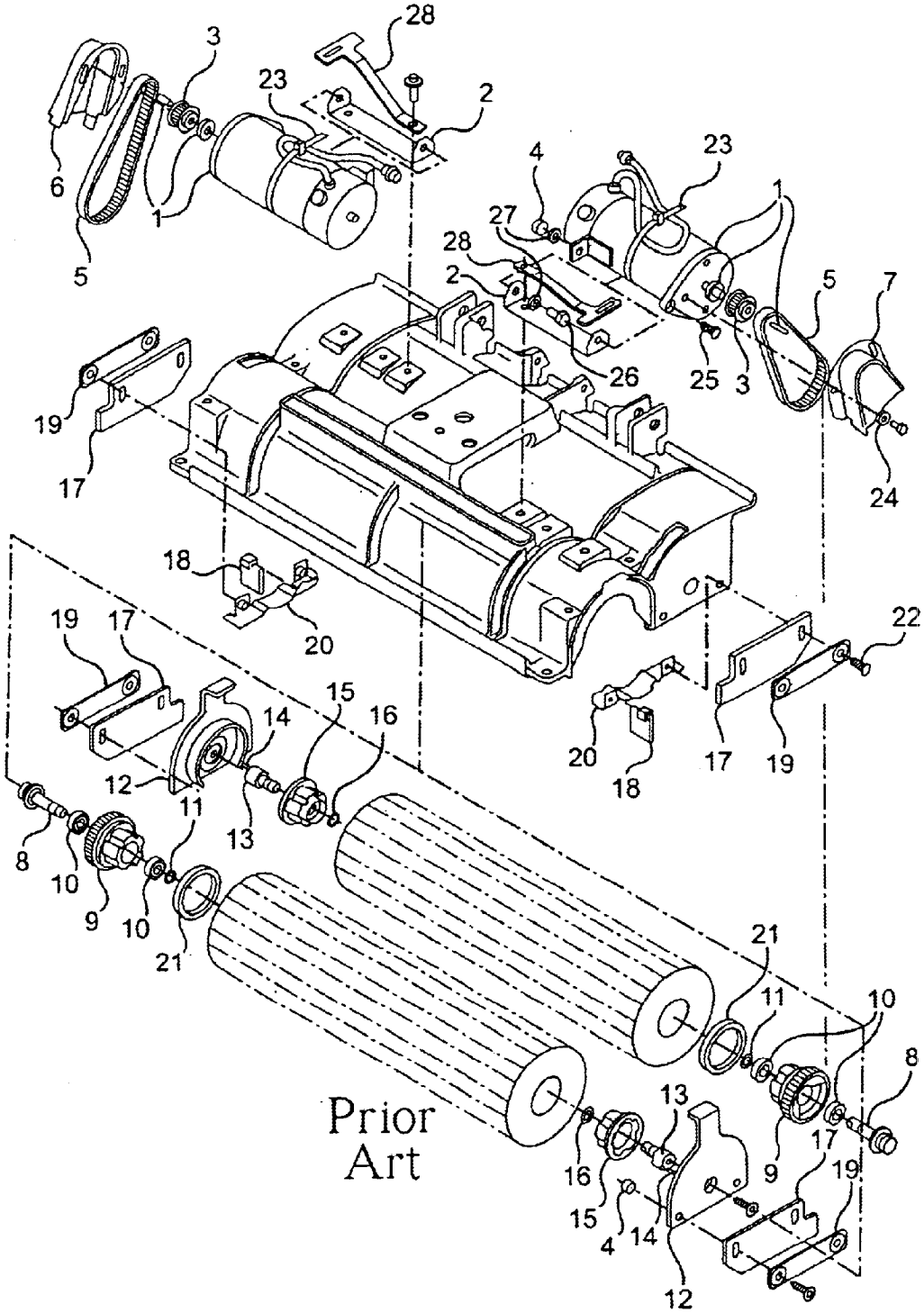
FIG. 3 is an exploded perspective view of a prior art dual brush assembly depicting the multiple fasteners coupling the idler-side portion of the assembly.

With reference to FIG. 3, depicting a prior art counter-rotating brush assembly in an exploded, perspective view illustrating the multiple threaded fasteners coupling the brush mounting structures to the idler-side portion of the counter-rotating brush assembly.

Figure 4:
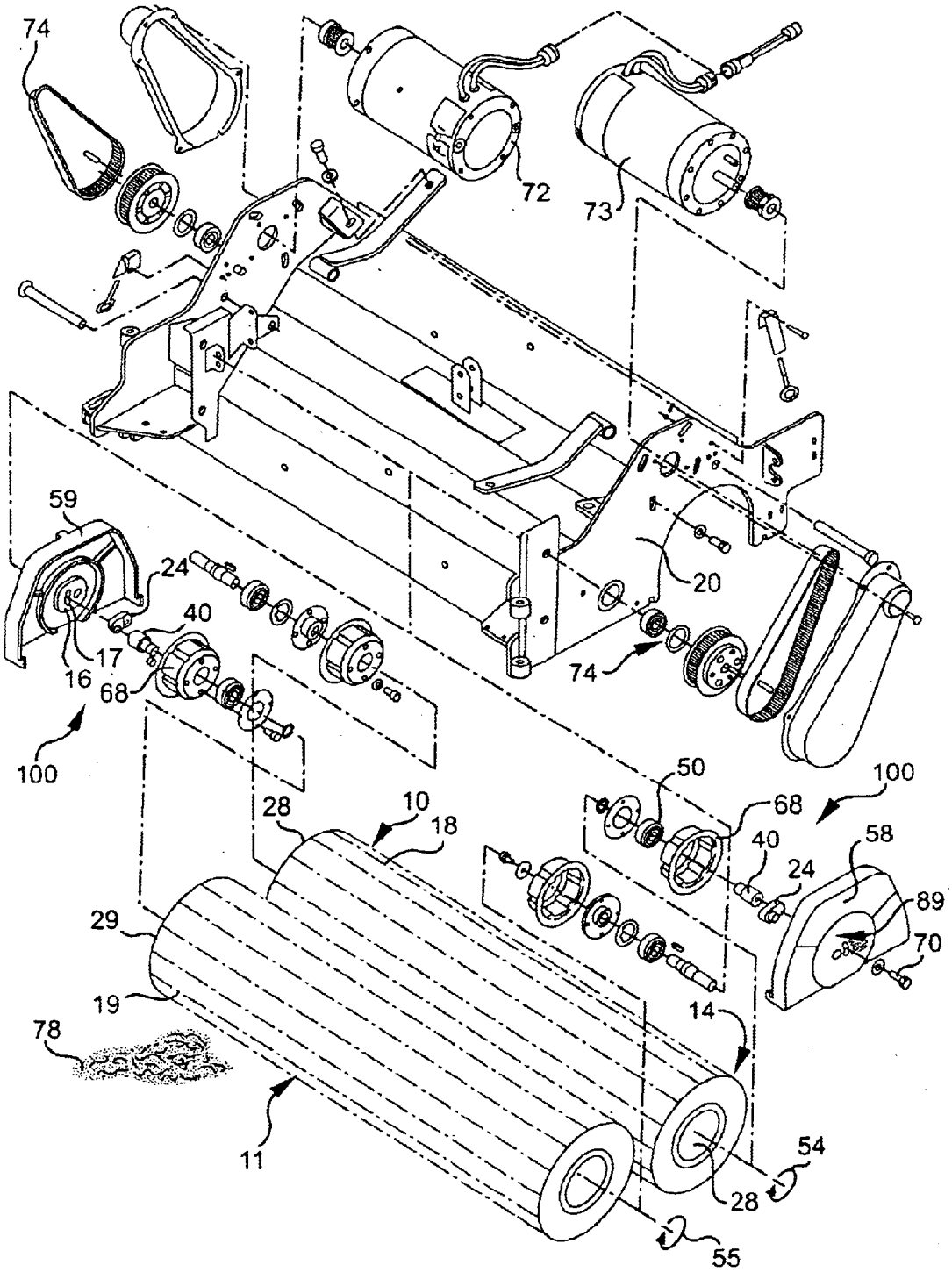
FIG. 4 is an exploded perspective view of a brush assembly according to the present invention wherein the brush alignment assembly includes a two-piece cam and an idler cover plate.
Figure 5A:
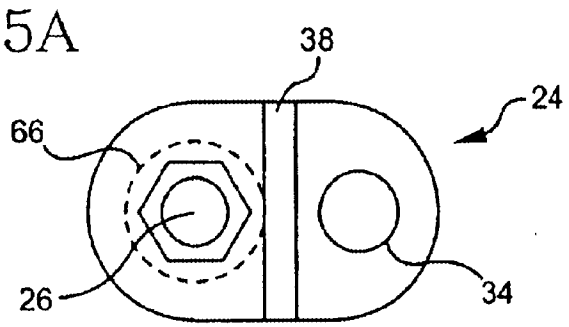
FIG. 5A is a bottom plan view of one embodiment of a first cam member.
Figure 5B:
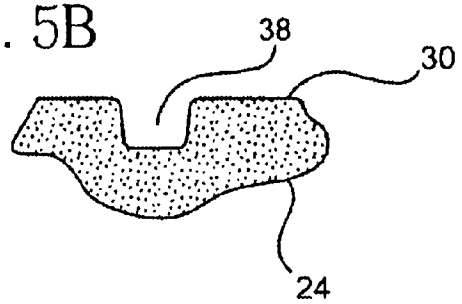
FIG. 5B is a partial cross sectional view of the first cam member of FIG. 5.
Figure 5C:
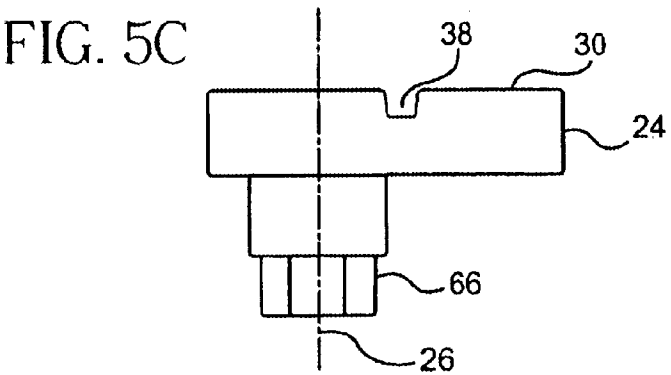
FIG. 5C is a side view of the first cam member of FIG. 5.
Figure 5D:
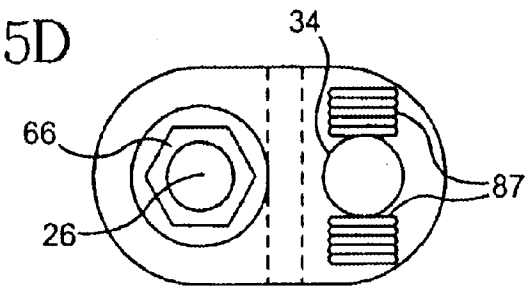
FIG. 5D is a top plan view of the first cam member of FIG. 5.
Figure 6C:
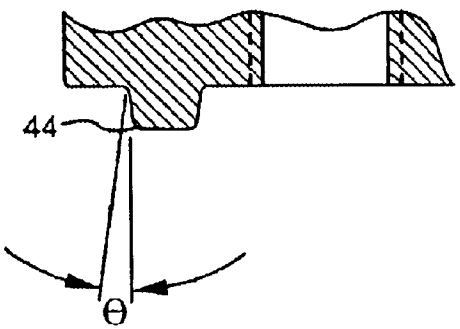
FIG. 6C is a top plan view of the second cam member of FIG. 6*a*.
Figure 6D:
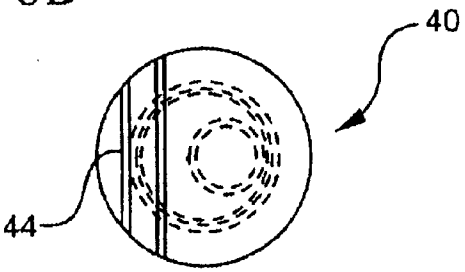
FIG. 6A is a side view of one embodiment of a second cam member and a rotary bearing assembly.
FIG. 6B is a partial cross sectional view of the first cam member of FIG. 6A.
Figure 6A:
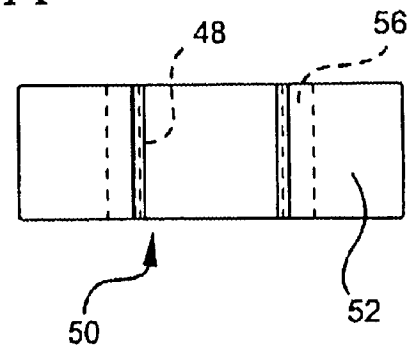
Figure 6B:
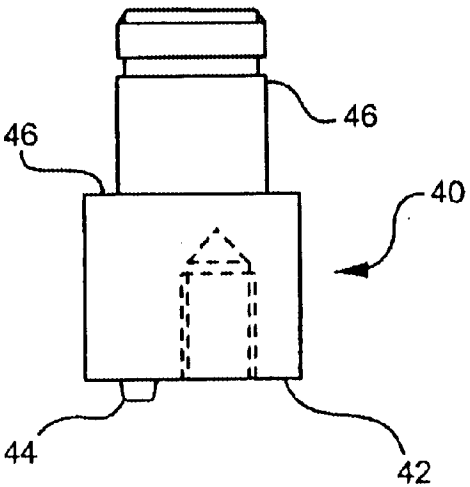
Figure 7B:
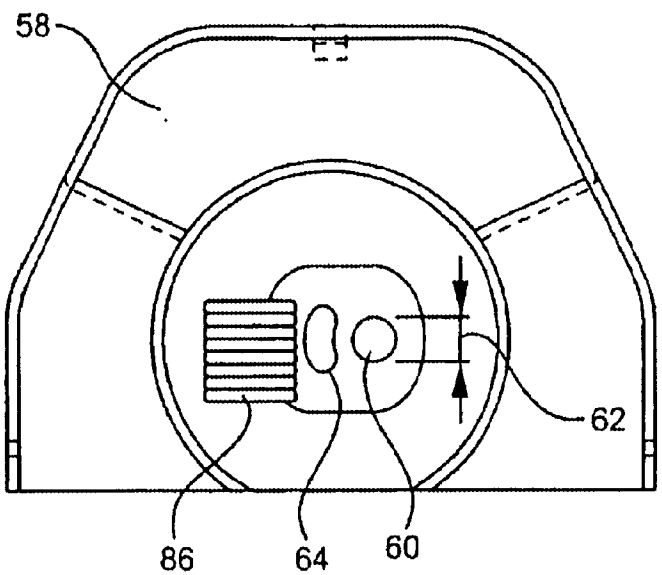
FIG. 7B is a bottom plan view of the housing member of FIG. 7A.
Figure 7A:
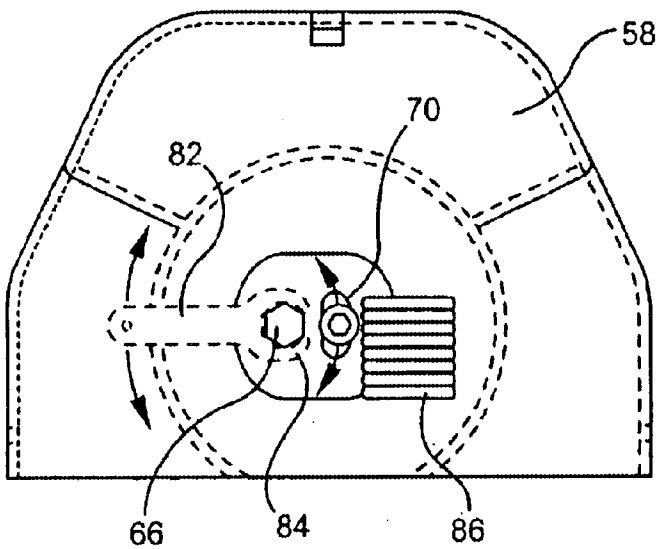
FIG. 7A is a top plan view of one embodiment of a housing member.

With reference to FIG. 4, a pair of adjustable assemblies 100 (encircled for ease of reference in FIG. 4) for a pair of a counter-rotating brush members 10,11 are depicted in an exploded, perspective view. The first substantially cylindrical brush member 10 has a first rotary attachment location 28 disposed at a first end 14 and having a second rotary attachment location 29 disposed at a second end 18 and each of said first end 14 and second end 18 rotatably coupled to a housing of a surface maintenance vehicle at a first and second rotational mounting location 12,16. A first cam member 24 having an axis of rotation 26 pivotably couples to the housing member 20 via cover member 58 disposed at the first rotational mounting location 12 (although it may couple directly to said housing member 20) and the first cam member 24 has a bore 34 formed therein and spaced from the axis of rotation 26 of said first cam member 24. The first cam member 24 further comprising a shallow, elongated recess 38 formed in one of said major surfaces 30 of the first cam member 24. The second cam member 40 mechanically couples to the major surface 30 of the first cam member 24 via a first side 42 of the second cam member 40. The second cam member has a ridge feature 44 formed on, and a bore 35 corresponding to bore 34 of cam member 24 formed partially into said first side 42 corresponding to said elongated recess 38 of the first cam 24 member. The bore 35 preferably does not extend through the cam member 40 but rather terminates in a threaded blind hole therein. A second side 46 of said second cam member 40 engages an first ring portion 48 of a bearing assembly 50, wherein the bearing assembly 50 has an second ring portion 52 coupled to an internal dust cover structure 68 (which is preferred, albeit not required to practice the present invention) around the rotational axis 55 of the substantially cylindrical brush member 10 and wherein a space 56 between the first ring portion 48 and the second ring portion 52 contains a material designed to reduce friction between said first ring portion 48 and second ring portion 52. Appropriate material for space 56 include traditional ball bearings and suitable lubrication or slider bearings and the like whether or not coated or supplied with grease, oil, friction-reducing compounds (such as Teflon®) and other suitable material that allows the first ring portion 48 to freely rotate relative to second ring portion 52. A cover member 58 having a first aperture, or port, 60 with a diameter dimension 62 and a second aperture 64, spaced from the first aperture 60, wherein said second aperture 64 preferably having an elongate shape (sized to accommodate a desired linear amount of adjustment for the brush assembly). The first aperture 60 is adapted to receive a hex, or head member, 66 and said second aperture 64 is adapted to receive an elongate shank member 70 and wherein the elongate shank member 70 also provides mechanical engagement between the first cam member 24 and the second cam member 40 and the inner ring portion 48 of the bearing assembly 50.

The adjustable assembly 100 may further comprising a motive force 72 mechanically coupled via suitable belts, gearing, bearings and the like (collectively 74) to the second attachment location 16 of the substantially cylindrical brush member 10 for driving said brush member 10 at a constant or at a variable or changing rate of rotation. The motive force 72 preferably provides an adjustable magnitude output force so that when said motive force 72 is increased the substantially cylindrical brush member 10 rotates more rapidly and when said motive force is decreased the substantially cylindrical brush member 10 rotates less rapidly.

In a preferred counter-rotating embodiment, the first brush member 10 is disposed relative to a second substantially cylindrical brush member 11 coupled to the housing 20 of the vehicle 22 and disposed with substantially parallel axes of counter-rotation 55 and spaced apart with each brush member contacting a surface 76 to be cleaned such that said first and said second substantially cylindrical brush members 10,11 cooperate together to urge particles and debris 78 present on said surface 76 to be cleaned away from said surface 76. When the two brush members 10,11 cooperatively remove said debris 78, a debris capture vessel (not shown) configured to temporarily collect said debris 76 receives said particles and debris. The debris capture vessel may be disposed at the end of a debris pathway (not shown) having various debris pathway flow conditioning deflectors (not shown) disposed therein to ensure retention of said particles and debris 78 in said vessel.

Of course, the motive force 72 may comprise and electrical motor coupled to the second attachment location 16 via at least one belt member driving a first driven gear member and via a second driven gear member (collectively 74) which is coupled to the rotational axis 54,55 of either one of the substantially cylindrical brush members 10,11. Either or both of said brush members 10,11 may be powered or driven via a single motive force 72 appropriated coupled to provide rotational motion of said brush members 10,11 or, in an alternate embodiment, a second motive force 73 couples to just the second substantially cylindrical brush member 11 for driving said second substantially cylindrical brush member 11 in a direction of rotation opposite the direction of rotation of said first substantially cylindrical brush member 10.

A preferred embodiment of the adjustable assembly of the present invention includes a single elongate rotary brush member 10 having a longitudinal axis of rotation 54 and a first rotational mounting structure 12 coupled to the elongate rotary brush member 10 at the longitudinal axis 54 at a first end 14 of the elongate rotary brush member 10 and a second rotational mounting structure 16 coupled to the elongate rotary brush member 10 at the longitudinal axis 54 at a second end 18 of the elongate rotary brush member. Thus, said elongate rotary brush member 10 freely rotates about said longitudinal axis 54 and is firmly coupled to its two respective rotational mounting structures 12,16 at all times. Disposed near first end 14 and close to location 28 and adjacent the first rotational mounting location 12 is provided an adjustable mechanism 100 spaced from the first rotational mounting structure 12. The adjustable mechanism 100 has a partially-released state and a fully-coupled state (or "lock-down" state), and in the event that the adjustable release mechanism 100 is in the partially-released state said first rotational mounting structure 12 may be moved while the elongate rotary brush member 10 remains coupled to said first rotational mounting structure 12 and to said second rotational mounting structure 16 so that the elongate rotary brush member 10 may freely rotate about the longitudinal axis 54. Following such movement of the first rotational mounting structure 12 the longitudinal axis 54 has a different spacing relative to the surface 76 so that the ends of a plurality of bristles associated with the brush 10 either have increased or reduced contact with said surface 76. In the event that the adjustable release mechanism 100 is in the fully-coupled state said first rotational mounting structure 12 may not be moved and the elongate rotary brush member 10 may freely rotate about the longitudinal axis 54.

A preferred method of operating the adjustable release mechanism 100 involves several steps to thereby adjust the spacing between the bristles of a powered rotary brush 10 and a surface to be brushed 76 without uncoupling a rotational coupling 12,16 or a power mechanism 72 for said rotary brush 10. The adjustable release mechanism 100 is preferably disposed at a first end 14 of the brush member 10, but may be oriented at any location where such power mechanism 72 may provide force urging the brush member 10 into rotation about rotational axis 54. Pursuant to the teaching of the present invention, the adjustable release mechanism 100 may transition from a fully coupled state by first releasing a coupling force at a first end of a powered rotary brush assembly without uncoupling the brush member 10 from its rotational mounting locations 12,16 and repositioning said first end 14 to a desired new elevation relative to a surface 76, and then increasing the coupling force at the first end so that the first end is thus repositioned and thereafter the brush member 10 is non-moveable from following said repositioning.

In addition, when transitioning from a fully-coupled to a partially-released state the coupling force may optionally include a rudimentary tool 84 manually applied to a connecting structure herein termed an adjustable head 66 which couples via aperture 60 formed in a cover 58 to first eccentric cam member 24 to adjustably retain said first end 14 of the rotary brush 10 in place when tightened.

Furthermore, when repositioning said first end 14 a further step may be performed in accordance with the present invention; namely, manipulating said rotary brush to increase or decrease the spacing of said rotary brush 10 relative to the surface 76 with reference to indicia 86 provided on the cover 58 adjacent aperture 64 or port 60 and/or otherwise provided adjacent the first rotational mounting 12. Increasing said coupling force at said first end 14 may include another step of manually applying a tool 82 having a structure receiving aperture, collar, recess or protrusion formed therein (collectively 84) to corresponding structure mechanically connected to produce said coupling force at the first end 14 of the rotary brush. Also, the indicia 86 may be used by an operator of a surface maintenance vehicle 22 operated in accordance with the present invention to rapidly and readily measure, test, and/or calibrate the spacing between the brush 10 and the surface 76. The indicia may be correlated in advance to provide an indication of the size of a contact area (or "footprint") of the brush 10 upon the surface 76 at differing adjustment settings of the adjustable mechanism 100. The contact area may either be determined when the vehicle 22 is stationary or moving and the indicia provided may also correlate to both such measurement of contact area. In this way, the referencing indicia may be used to rapidly and readily confirm an effective increase or decrease in the spacing of said rotary brush member 10 relative to said surface 76. The repositioning of the brush member 10 relative to the surface 76 may thus further include the step of referencing the indicia 86 of relative spacing between said first end of the rotary brush assembly, wherein said indicia appears adjacent said first end 14. Of course, said indicia 86 may be provided at either or both of the first end 14 or second end 18 with similar effect.

Also, while the adjustable mechanism 100 is depicted and fully described disposed at said first end 14, the mechanism 100 maybe employed at the second end 18 with similar results. The mechanism 100 may be readily used on both ends 14,18 of a brush member 10 particularly if the motive force 72 is not directly coupled at either end 14,18 (and thus potentially interfere with the adjustment thereby).

The indicia 86 may further comprise two sets of individual corresponding indicia, a first set 87 corresponding to the position of first end 14 and a second set 89 corresponding to the housing structure 20, preferably disposed adjacent said first end 14.

As mentioned, a second powered rotary brush 11 may be rotationally coupled to said housing 20 and disposed adjacent the first powered rotary brush 10 and, in addition to performing the steps set forth above performing the additional steps of releasing a coupling force at the first end 15 of a second powered rotary brush 11 and repositioning said first end 15 of the second powered rotary brush 11 and related rotational mounting locations 17 and increasing the coupling force at the first end 15 of the second powered rotary brush 11. Furthermore, a step of manually reducing and subsequently increasing said coupling force at the first end 15 of the second rotary brush assembly when the second rotary brush member 11 is positioned as desired for operation.

Note that the repositioning said first end 15 of brush 11 may further include the step of manipulating said rotary brush assembly either by hand or with a tool to increase leverage (not shown) to increase or decrease the spacing of said rotary brush assembly relative to a surface 76. Of course diverse means are available to move, or translate, the brush assembly in the event that same is too unwieldy, heavy or large for manual manipulation. For example, an electric stepper motor, a servo motor, pneumatic drive means, hydraulic means, a mechanical leadscrew (or other linear actuator), pulley system, or every other manner of controllably directing force to adjust or translate said assembly will suffice so long as they are suitably adapted to move the brush assembly. The above means may be locally or remotely controlled by the operator of the vehicle and should be provided with appropriate mechanical stop features and/or displays or signals indicating the amount of travel and/or start and stop sequences.

Since an object of the present invention is to inexpensively and simply provide the necessary repositioning of the brush assembly, the preferred means of accomplishing such translation if by manually pivoting a first one of a pair of interlocking cam structures 24,40 to permit a linear displacement of said first end 15 relative to the surface 76. Of course, interlocking cam structures 24,40 may be integrated into a single monolithic structure providing the necessary pivoting provided by the combined interlocking cam structures 24,40. The cam structures 24,40 (and by analogy a monolithic variety of same) is preferably formed of powder metal passivated for corrosion resistance (a suitable material is identified as "SS 304NI-30" which is generally available from a variety of sources. Although other suitable materials for fabricating interlocking cam structures 24,40 include: corrosion resistant metals, composite materials, ceramic material, tempered metals, stainless steel, resilient resin-based materials (if stiff enough for duty pursuant to the present invention), milled or molded or cast resilient materials, brass and bronze and the like.

Preferably the first one of said pair of interlocking structures further comprises a eccentric cam member 24 having a first elongate channel, or recess, 38 formed in the first cam member 24. The second cam structure 40 attaches to the first cam 24 at a first end 42 of second cam 40 and preferably a ridge feature 44 (or other rotation-restraining feature such as a boss or pin member which should then correspond to the features of recess 38) corresponding to and mechanically cooperating with the recess 38 of similar size and shape to the ridge feature 43 help the first cam 24 and second cam 40 retain their desired configuration in relation to the other. These corresponding pin and channel combinations are helpful but not required to practice the teaching and techniques of the present invention. Likewise, more than a single pair of such pin and channel pairs may be distributed at the various interconnections between components and subcomponents used in conjunction with the present inventive powered rotary brush adjustable coupling.

An adjustable assembly according to the present invention requires only the following elements in combination; namely, (i) an elongate rotary brush member 10 having a longitudinal axis of rotation 54 and (ii) a first rotational mounting structure 12 coupled to the elongate rotary brush member 10 at the longitudinal axis 54 at a first end 14 of the elongate rotary brush member 10 and (iii) a second rotational mounting structure 16 coupled to the elongate rotary brush member 10 at the longitudinal axis 54 at a first end 14 of the elongate rotary brush member 10 so that said elongate rotary brush member freely rotates about said longitudinal axis and (iv) an adjustable mechanism 100 disposed adjacent but spaced from the first rotational mounting structure 12, wherein said adjustable mechanism 100 has a partially-released state and a fully-coupled state, and in the event that the adjustable release mechanism 100 is in the partially-released state: (a) the first rotational mounting structure 12 may be moved while the elongate rotary brush member 10 remains coupled to said first rotational mounting structure 12 and said second rotational mounting structure 16 and said elongate rotary brush member 10 may freely rotate about the longitudinal axis 54; and, (b) in the event that the adjustable release mechanism 100 is in the fully-coupled state said first rotational mounting structure 12 may not be moved and the elongate rotary brush member 10 may freely rotate about the longitudinal axis 54.

In addition, a so-called kill (or dead hand) switch may be provided in conjunction with the present invention so that the motor of the vehicle 22 and/or the brush motor(s) 72,73 will not operate in the event that a rotary brush or brushes or the adjustment head 66 are being adjusted.

While the present invention has been described with a focus on an idler-side adjustment of the spacing of one end of a rotary brush in order to simply use thereof in view of the complexity of removing a motor 72,73 and/or associated belts, gears and connecting members (collectively 74) as are typically disposed at one end of such rotary brush assemblies. Without substantial modification from the teaching hereof a similar, or identical, adjustment mechanism (and methods of adjusting same) may be implemented without limitation as to which end of the rotary brush the adjustment mechanism is applied. That is, the motor and associated motor coupling apparatus may be temporarily loosened or completely disconnected from either end of said rotary brush and may be adjusted relative to a corresponding surface and taught, enabled and claimed herein.

We claim the following:

1. An adjustable assembly for a powered rotating brush member operating in a surface maintenance vehicle comprising:

a brush assembly housing member having a first aperture and a second aperture spaced from the first aperture;

a substantially cylindrical brush member having a rotary bearing assembly connected at a first end; and a coupling mechanism comprising a first cam member having an adjustment head protruding from a first side and a bore spaced from the adjustment head, the head and the bore positioned to correspond to the first and second aperture, respectively, a second cam member having a first side with a third aperture aligned with the bore and a second side of the second cam member adapted to engage the rotary bearing assembly, and a connecting member extending through the second aperture and the bore and engaging the third aperture.

2. An adjustable assembly for a rotating brush member operating in a surface maintenance vehicle according to claim 1, wherein the rotary bearing assembly further comprises a first ring portion and a second ring portion spaced from the first ring portion, the second ring portion is coupled to the substantially cylindrical brush member and wherein a material designed to reduce friction between said first ring portion and said second ring portion is disposed in a space between said first ring portion and second ring portion.

3. An adjustable assembly for a rotating brush member operating in a surface maintenance vehicle according to claim 1, wherein said brush assembly housing member further comprises a removable cover portion mechanically connected to said housing member.

4. An adjustable assembly for a rotating brush member operating in a surface maintenance vehicle according to claim 1, wherein a ridge member protrudes from the first side of the second cam member which engages a corresponding elongate recess formed in a second side of the first cam member to inhibit motion therebetween.

5. An adjustable assembly for a rotating brush member operating in a surface maintenance vehicle according to claim 4, wherein the ridge member is formed as at least one pin member and the elongate recess is formed to correspond to the at least one pin.

6. An adjustable assembly for a rotating brush member operating in a surface maintenance vehicle according to claim 1, wherein the adjustment head is bonded into a port formed in said first cam member.

7. An adjustable assembly for a rotating brush member operating in a surface maintenance vehicle according to claim 1, wherein the first cam member is fabricated of at least one of the following materials: metal, powdered metal, ceramic, composite, resin-based, and any of the above further comprising fiber-impregnation or heat tempering and wherein the first cam member is fabricated by any one or more of the following: cast, milled, molded, sculpted or etched into appropriate shape.

8. An adjustable assembly for a rotating brush member operating in a surface maintenance vehicle according to claim 1, wherein the second aperture is elongated in shape.

9. An adjustable assembly for a rotating brush member operating in a surface maintenance vehicle according to claim 1, wherein a power source for rotating said substantially cylindrical brush member is coupled to the substantially cylindrical brush member via a belt member.

10. An adjustable assembly for a rotating brush member operating in a surface maintenance vehicle according to claim 9, wherein the power source is coupled to the substantially cylindrical brush member at a first end of said substantially cylindrical brush member.

11. An adjustable assembly for one of a pair of counter-rotating brush members operating in a surface maintenance vehicle, comprising:

a housing member having a first aperture and a second aperture, spaced from the first aperture, wherein said second aperture has an elongate shape;

a substantially cylindrical first brush member having a first attachment location disposed at a first end; and a first cam member pivotably coupled to the housing member, wherein the first cam member has an adjustment head protruding from a first side, a bore spaced from the adjustment head and a ridge-receiving elongate recess formed on a second side; and a second cam member mechanically coupled to the second side of the first cam member on a first side of the second cam member and wherein the first side of the second cam member has a threaded blind hole formed therein aligned with the second aperture of the housing member and a ridge feature formed thereon corresponding to said ridge-receiving elongate recess and a second side of said second cam member adapted to engage the first attachment location.

12. An adjustable assembly according to claim 11, further comprising a motive force mechanically coupled to the substantially cylindrical brush member.

13. An adjustable assembly according to claim 12, wherein said motive force provides an adjustable magnitude output force so that when said motive force is increased the substantially cylindrical brush member rotates more rapidly and when said motive force is decreased the substantially cylindrical brush member rotates less rapidly.

14. An adjustable assembly according to claim 12, wherein said motive force is an electrical motor coupled to the substantially cylindrical brush member via at least one belt member driving a first driven gear member.

15. An adjustable assembly according to claim 11, further comprising a debris capture vessel configured to temporarily collect particles and debris.

16. An adjustable assembly according to claim 11, further comprising a second substantially cylindrical brush member and a second motive force coupled to the second substantially cylindrical brush member for driving said second substantially cylindrical brush member in a direction of rotation opposite the direction of rotation of said first substantially cylindrical brush member.

17. An adjustable assembly according to claim 11, wherein ridge feature of the second cam member is formed as a pin corresponding to said pin-receiving recess of the first cam member.

18. An adjustable assembly, comprising:

an elongate rotary brush member having a longitudinal axis of rotation;

a first rotational mounting structure coupled to the elongate rotary brush member at the longitudinal axis at a first end of the elongate rotary brush member and a second rotational mounting structure coupled to the elongate rotary brush member at the longitudinal axis at a second end of the elongate rotary brush member so that said elongate rotary brush member freely rotates about said longitudinal axis;

a pair of coupling mechanisms coupling the elongate rotary brush to the respective first and second rotational mounting structures, each coupling mechanism comprising a cam member having a first side with an adjustment head protruding therefrom, the adjustment heads rotatively coupled to a respective one of the first and second rotational mounting structures and a second side of each cam member adapted to eccentrically and rotatably engage respective ends of the rotary brush member; and, a source of rotational motion coupled to the second end of the elongate rotary brush.

19. An adjustable brush assembly comprising:

a housing member having a first aperture and a second aperture spaced from the first aperture;

a cylindrical brush member; and a cam member having an adjustment head protruding from a first side, a bore spaced from the adjustment head, and a second side adapted to engage the cylindrical brush member, the adjustment head rotatively engages the first aperture; and a connecting member extending through the second aperture and engaging the bore.

20. The assembly of claim 19, wherein the second aperture is elongated and adapted to allow the connecting member to travel in a generally longitudinal direction along the second aperture by rotating the adjustment head.

21. The assembly of claim 19, and further comprising a motive force coupled to the cylindrical brush member.

22. The assembly of claim 19, wherein the cam member is comprised of a first and second cam member, with the first cam member having an adjustment head protruding from a first side and a bore spaced from the adjustment head, the head and the bore positioned to correspond to the first and second aperture, respectively, the second cam member having a first side with a third aperture aligned with the bore and a second side of the second cam member adapted to engage the cylindrical brush member.

* * * * *